US008509462B2

(12) United States Patent
Jeong et al.

(10) Patent No.: US 8,509,462 B2
(45) Date of Patent: Aug. 13, 2013

(54) PIEZOELECTRIC MICRO SPEAKER INCLUDING ANNULAR RING-SHAPED VIBRATING MEMBRANES AND METHOD OF MANUFACTURING THE PIEZOELECTRIC MICRO SPEAKER

(75) Inventors: Byung-gil Jeong, Anyang-si (KR); Dong-kyun Kim, Suwon-si (KR); Seok-whan Chung, Suwon-si (KR); Jun-sik Hwang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 489 days.

(21) Appl. No.: 12/704,029

(22) Filed: Feb. 11, 2010

(65) Prior Publication Data

US 2011/0064250 A1 Mar. 17, 2011

(30) Foreign Application Priority Data

Sep. 16, 2009 (KR) ..... 10-2009-0087641

(51) Int. Cl.
*H04R 25/00* (2006.01)

(52) U.S. Cl.
USPC ..... 381/174; 381/173; 381/431

(58) Field of Classification Search
USPC ..... 381/173, 174, 431
See application file for complete search history.

(56) References Cited

U.S. PATENT DOCUMENTS

| | | | | |
|---|---|---|---|---|
| 4,395,652 | A * | 7/1983 | Nakanishi et al. | 310/334 |
| 4,816,125 | A | 3/1989 | Muller et al. | |
| 5,209,118 | A | 5/1993 | Jerman | |
| 5,452,267 | A | 9/1995 | Spevak | |
| 5,633,552 | A | 5/1997 | Lee et al. | |
| 6,857,501 | B1 | 2/2005 | Han et al. | |
| 7,177,434 | B2 | 2/2007 | Tripoli | |
| 2002/0118849 | A1 | 8/2002 | Chang et al. | |
| 2009/0161906 | A1 * | 6/2009 | Adelman | 381/418 |

FOREIGN PATENT DOCUMENTS

| | | | |
|---|---|---|---|
| JP | 58-096495 | A | 6/1983 |
| JP | 61-252799 | A | 11/1986 |
| JP | 63-103599 | A | 5/1988 |
| JP | 2-158297 | A | 6/1990 |
| JP | 2-266799 | A | 10/1990 |
| JP | 2005-027000 | A | 1/2005 |
| KR | 10-20100-033807 | A | 3/2010 |
| KR | 10-2010-0034883 | A | 4/2010 |
| KR | 10-2010-0071607 | A | 6/2010 |

* cited by examiner

*Primary Examiner* — Davetta W Goins
*Assistant Examiner* — Amir Etesam
(74) *Attorney, Agent, or Firm* — Sughrue Mion, PLLC

(57) ABSTRACT

A piezoelectric micro speaker and a method of manufacturing the same are provided. The piezoelectric micro speaker includes a substrate having a cavity formed therein and a diaphragm that is disposed on the substrate that overlaps the cavity. A plurality of first vibrating membranes having concentric annular ring shapes are disposed in a first region of the diaphragm corresponding to a center of the cavity. A second vibrating membrane including a different material from that of the first vibrating membranes is formed in the second region of the diaphragm corresponding to an edge of the cavity. A piezoelectric actuator for vibrating the first vibrating membranes is formed on and between the concentric annular rings of the first vibrating membranes.

20 Claims, 8 Drawing Sheets

PIEZOELECTRIC MICRO SPEAKER INCLUDING ANNULAR RING-SHAPED VIBRATING MEMBRANES AND METHOD OF MANUFACTURING THE PIEZOELECTRIC MICRO SPEAKER

CROSS-REFERENCE TO RELATED PATENT APPLICATION

This application claims priority from Korean Patent Application No. 10-2009-0087641, filed on Sep. 16, 2009, in the Korean Intellectual Property Office, the disclosure of which is incorporated herein in its entirety by reference.

BACKGROUND

1. Field

One or more embodiments relate to a piezoelectric micro speaker, and more particularly, to a piezoelectric micro speaker including annular ring-shaped vibrating membranes and a method of manufacturing the piezoelectric micro speaker.

2. Description of the Related Art

Due to rapid development of terminals for personal voice communications and data communications, amounts of data to be transmitted and received has increased, while the terminals are required to be small and multifunctional.

In response to these trends, research into acoustic devices using micro electro mechanical system (MEMS) technology has been conducted. In particular, MEMS technology and semiconductor technology make it possible to manufacture microspeakers with small size and low cost according to a package process and to easily integrate microspeakers with peripheral circuits.

Speakers using MEMS technology can be categorized into electrostatic-type speakers, electromagnetic-type speakers, and piezoelectric-type speakers. Piezoelectric micro speakers can be driven at lower voltages than electrostatic-type speakers, and have simpler and slimmer structures than electromagnetic-type speakers.

SUMMARY

Provided are piezoelectric micro speakers including annular ring-shaped vibrating membranes and methods of manufacturing the piezoelectric micro speaker.

Additional aspects will be set forth in part in the description which follows and, in part, will be apparent from the description, or may be learned by practice of the presented embodiments.

According to one or more embodiments, a micro speaker includes: a substrate having a cavity formed therein; a diaphragm that is disposed on the substrate and overlaps the cavity, the diaphragm including a plurality of first vibrating membranes that are disposed in a first region of the diaphragm corresponding to a center of the cavity and have concentric annular ring shapes; and a piezoelectric actuator that is disposed on and between the first vibrating membranes.

The piezoelectric actuator may include a first electrode layer that is disposed on and between the first vibrating membranes, a piezoelectric layer that is disposed on the first electrode layer, and a second electrode layer that is disposed on the piezoelectric layer, and each of the a first vibrating membranes may be separated from an adjacent first vibrating membrane by a distance that is more than twice a thickness of the piezoelectric actuator. The piezoelectric actuator may have a corrugated cross-sectional shape in which the first electrode layer and the second electrode layer face each other in a vertical direction in areas between the first vibrating membranes and face each other in a horizontal direction in areas on the top surfaces of the first vibrating membranes.

The micro speaker may further include a first lead line and a second lead line that are disposed on the diaphragm, wherein the first lead line is connected to the first electrode layer and the second lead line is connected to the second electrode layer and a first electrode pad connected to an end of the first lead line and a second electrode pad connected to an end of the second lead line. The piezoelectric actuator may be interposed between the first lead line and the second lead line, and the first lead line and the second lead line may extend from the piezoelectric actuator in opposite directions.

The diaphragm may further include a second vibrating membrane that is disposed in a second region of the diaphragm corresponding to an edge of the cavity and includes a material different from a material of the first vibrating membranes.

The material of the second vibrating membrane may have an elastic modulus that is lower than an elastic modulus of the material of the first vibrating membranes, for example, a polymer thin film.

The second vibrating membrane may be disposed in the second region of the diaphragm, may be disposed on a top surface of the piezoelectric actuator in the first region, and may be disposed on a top surface of the diaphragm in a region surrounding the second region.

According to one or more embodiments, a method of manufacturing a micro speaker includes: forming a diaphragm on a substrate; forming a plurality of first vibrating membranes having concentric annular ring shapes by patterning the diaphragm; forming a piezoelectric actuator on and between the first vibrating membranes; and forming a cavity in the substrate in a thickness direction of the substrate by etching the substrate until the first vibrating membranes are exposed such that the first vibrating membranes are disposed in a first region corresponding to a center of the cavity.

The piezoelectric actuator may be formed by forming a first electrode layer and between the first vibrating membranes, forming a piezoelectric layer on the first electrode layer, and forming a second electrode layer on the piezoelectric actuator.

Each of the first vibrating membranes may be separated from an adjacent first vibrating membrane by a distance that is more than twice a thickness of the piezoelectric actuator. The piezoelectric actuator may have a corrugated cross-sectional shape, such that the first electrode layer and the second electrode layer face each other in a vertical direction in areas between the first vibrating membranes and face each other in a horizontal direction in areas on the top surfaces of the first vibrating membranes.

The forming of a piezoelectric actuator may include: forming a first lead line and a second lead line on the diaphragm, such that the first lead line is connected to the first electrode layer and the second lead line is connected to the second electrode layer; and forming an electrode pad at an end of each of the first lead line and the second lead line. The piezoelectric actuator may be interposed between the first lead line and the second lead line, ad the first lead line and the second lead line may extend from the piezoelectric actuator in opposite directions.

The forming of a plurality of first vibrating membranes may include forming a trench surrounding the first vibrating membranes in a second region, and forming the cavity may include forming the cavity such that an edge of the cavity corresponds to the second region. The method may further include, after the forming of the piezoelectric actuator, forming a second vibrating membrane in the trench, wherein the second vibrating membrane includes a material different from a material of the first vibrating membranes.

The second vibrating membrane may include a material having an elastic modulus lower than an elastic modulus of the material of the first vibrating membranes, for example, a polymer thin film.

The forming of the second vibrating membrane may further comprise forming, the second vibrating membrane in the second region, forming the second vibrating membrane on a top surface of the piezoelectric actuator in the first region, and forming the vibrating membrane on a top surface of the diaphragm in a region surrounding the second region.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
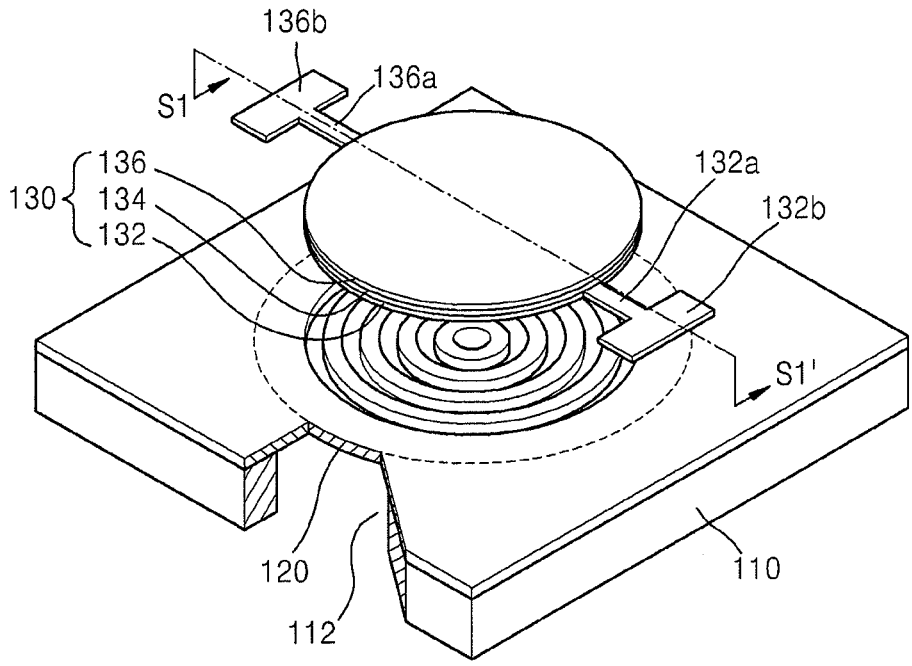
FIG. 1 is a perspective view of a piezoelectric micro speaker according to an embodiment, wherein in the piezoelectric micro speaker, a piezoelectric actuator is separated from first vibrating membranes.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2:
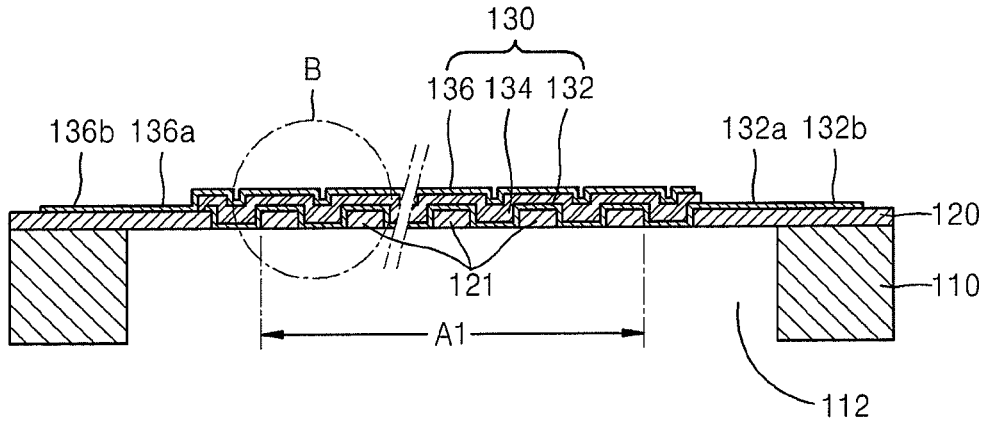
FIG. 2 is a cross-sectional view taken along a line S1-S1' of the piezoelectric micro speaker of FIG. 1, according to an exemplary embodiment.
Figure 3:
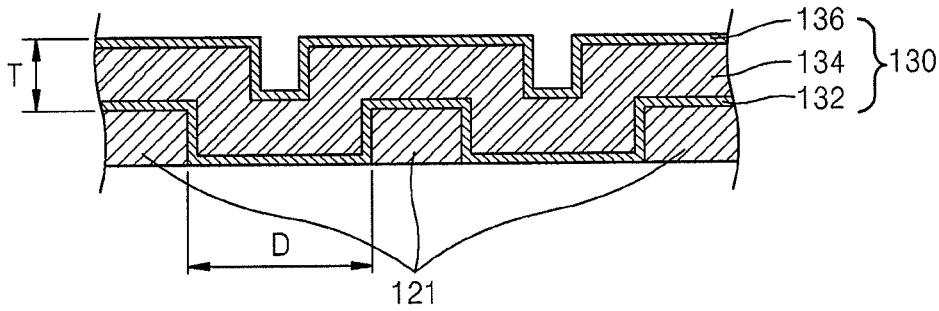
FIG. 3 is an enlarged view of a portion B of FIG. 2, illustrating the first vibrating membranes and the piezoelectric actuator in detail, according to an embodiment.

FIG. 1 is a perspective view of a piezoelectric micro speaker according to an embodiment. Referring to FIG. 1, in the piezoelectric micro speaker according to the present embodiment, a piezoelectric actuator 130 is illustrated as separated from a plurality of first vibrating membranes 121. FIG. 2 is a cross-sectional view taken along a line S1-S1' of the piezoelectric micro speaker of FIG. 1. FIG. 3 is an enlarged view of a portion B of FIG. 2, illustrating the first vibrating membranes 121 and the piezoelectric actuator 130 in detail.

Referring to FIGS. 1 and 2, the piezoelectric micro speaker according to the present embodiment includes a substrate 110 having a cavity 112, a diaphragm 120 including the first vibrating membranes 121 each having an annular ring shape, and the piezoelectric actuator 130 formed on the first vibrating membranes 121. The diaphragm 120 is formed on the substrate 110 such that the diaphragm 120 covers the cavity 112, The substrate 110 may be a silicon wafer having excellent micro-processability. The cavity 112 is formed in a thickness direction in a portion of the substrate 110. The cavity 112 may have, for example, a cylindrical shape.

The diaphragm 120 may be formed on a surface of the substrate 110 and may have a predetermined thickness. The first vibrating membranes 121 may be formed in a first region Al of the diaphragm 120 corresponding to the center of the cavity 112, and may have concentric annular ring shapes. The first vibrating membranes 121 may include an insulating material such as silicon nitride, for example, $Si_3N_4$.

The piezoelectric actuator 130 may vibrate the first vibrating membranes 121, and may include a first electrode layer 132, a piezoelectric layer 134, and a second electrode layer 136, which are sequentially stacked in this stated order on a top surface of and between the first vibrating membranes 121. The first electrode layer 132 and the second electrode layer 136 may include a conducting metallic material, and the piezoelectric layer 134 may include a piezoelectric material, for example, AN, ZnO or PZT.

A first lead line 132*a* that is connected to the first electrode layer 132 of the piezoelectric actuator 130 and a second lead line 136*a* that is connected to the second electrode layer 136 of the piezoelectric actuator 130 may be formed on the diaphragm 120. The first lead line 132*a* and the second lead line 136*a* may extend in opposite directions to each other while the piezoelectric actuator 130 is interposed therebetween. A first electrode pad 132*b* is formed at an end of the first lead line 132*a*, and a second electrode pad 136*b* is formed at an end of the second lead line 136*a*.

Referring to FIG. 3, adjacent first vibrating membranes 121 may be spaced apart from each other by a predetermined distance D which may be at least twice a thickness T of the piezoelectric actuator 130. Since the piezoelectric actuator 130 is formed on the top surface of and between the first vibrating membranes 121 as described above, the piezoelectric actuator 130 may have a corrugated cross-sectional shape. Thus, the first electrode layer 132 and the second electrode layer 136 of the piezoelectric actuator 130 may face each other in vertical and horizontal directions between the first vibrating membranes 121.

Figure 4A:
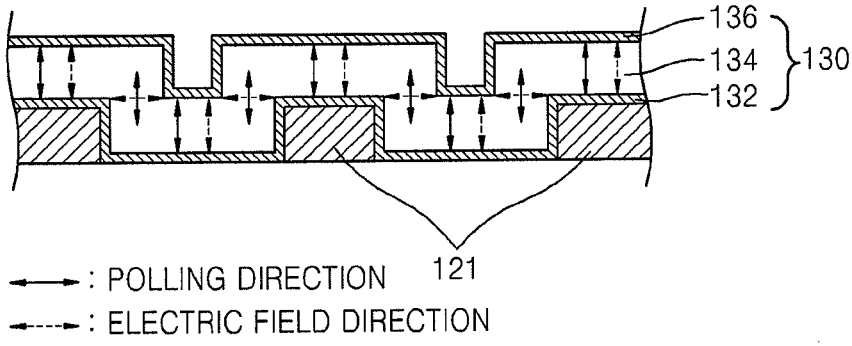
FIG. 4A illustrates a polling direction and an electric field direction in the first vibrating membranes and the piezoelectric actuator of FIG. 3.
Figure 4B:
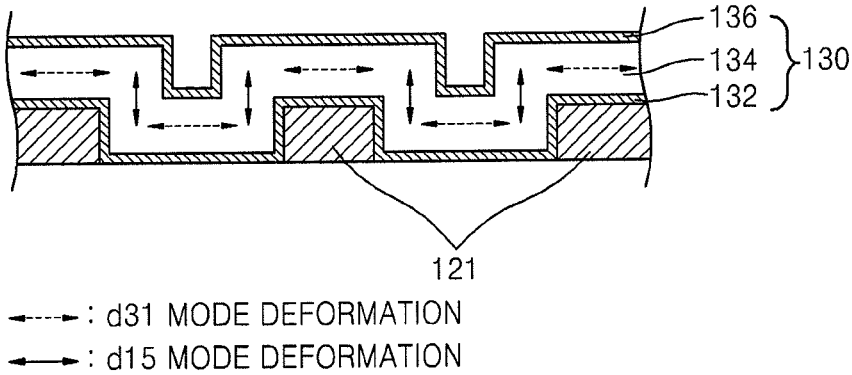
FIG. 4B illustrates deformation modes induced in a piezoelectric layer of the piezoelectric actuator according to the polling direction and the electric field direction illustrated in FIG. 4A, according to an embodiment.

FIG. 4A illustrates a polling direction and an electric field direction in the first vibrating membranes 121 and the piezoelectric actuator 130 of FIG. 3, and FIG. 4B illustrates deformation modes induced in the piezoelectric layer 134 of the piezoelectric actuator 130 according to the polling direction and the electric field direction illustrated in FIG. 4A.

Referring to FIG. 4A, when a voltage is applied between the first electrode layer 132 and the second electrode layer 136 through the first lead line 132*a* and the second lead line 136*a*, an electric field is formed inside the piezoelectric layer 134. In this regard, the polling direction of the piezoelectric layer 134 is always a vertical direction in any location, but the electric field direction of the piezoelectric layer 134 may vary according to a location. For example, as described above, a vertical electric field may be formed in a portion of the piezoelectric layer 134 where the first electrode layer 132 and second electrode layer 136 of the piezoelectric actuator 130 vertically face each other, and a horizontal electric field may be formed in a portion of the piezoelectric layer 134 where the first electrode layer 132 and the second electrode layer 136 face each other in the horizontal direction, between the first vibrating membranes 121.

As illustrated in FIG. 4B, when the polling direction is vertically parallel to the electric field direction, a horizontal d31 mode deformation may be induced in the piezoelectric layer 134, and when the polling direction is perpendicular to the electric field direction, a vertical d15 mode deformation may be induced in the piezoelectric layer 134.

In a related art micro speaker including a vibrating membrane having a flat shape, only the horizontal d31 mode deformation is induced in the piezoelectric layer. However, in the piezoelectric micro speaker including the first vibrating membranes 121 each having an annular ring shape, the vertical d15 mode deformation is induced together with the horizontal d31 mode deformation in the piezoelectric layer 134. Thus, the piezoelectric layer 134 may be more deformed, and thus the first vibrating membranes 121 that vibrate by deformation of the piezoelectric layer 134 are more displaced, and thus acoustic output that is generated by vibration of the first vibrating membranes 121 may also be increased.

In addition, since the first vibrating membranes 121 are spaced apart from each other and each of the first vibrating membranes 121 has an annular ring shape, the first vibrating membranes 121 have less rigidity against deformation than a conventional vibrating membrane having a flat shape, and thus greater displacement of the first vibrating membranes 121 may contribute to higher acoustic output.

Figure 5:
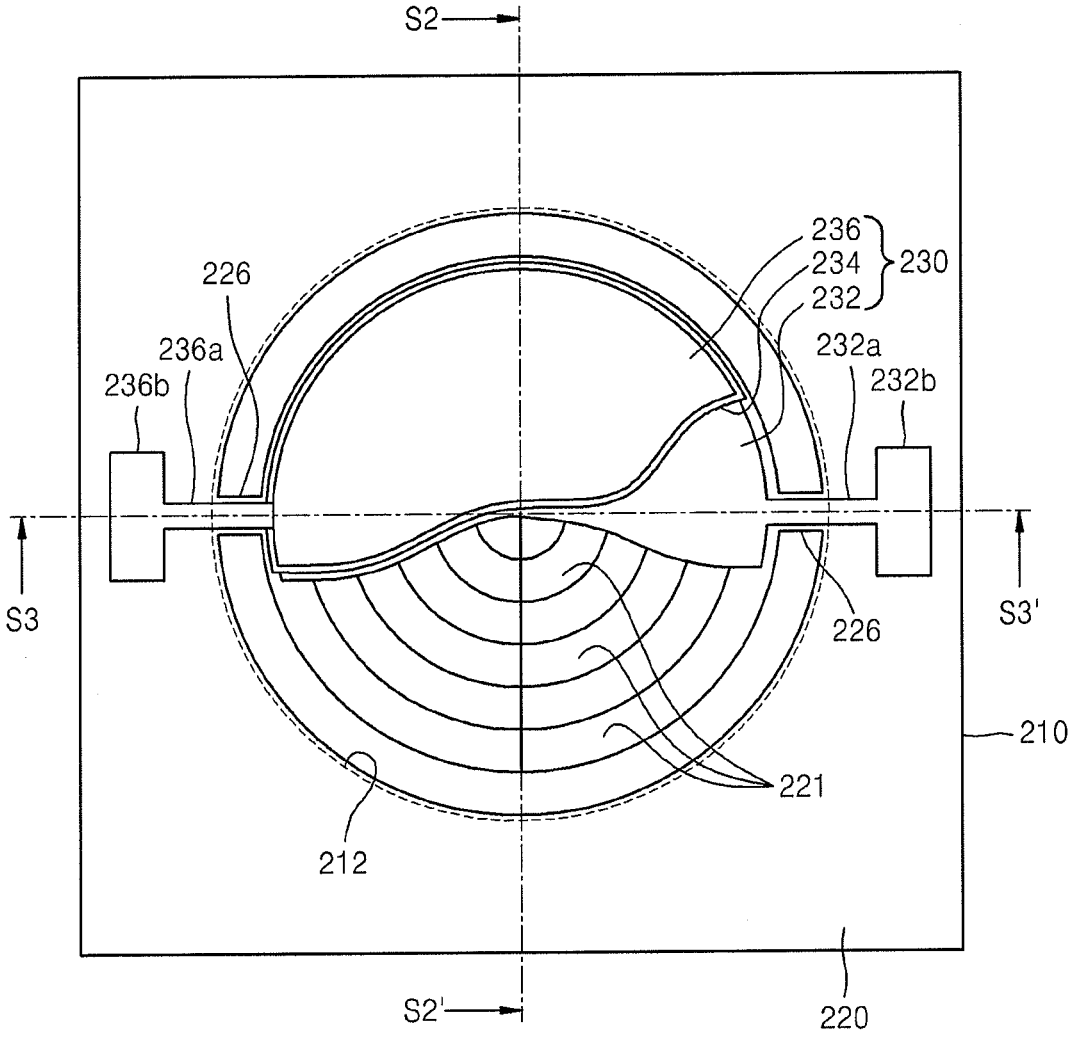
FIG. 5 is a plan view of a piezoelectric micro speaker according to another embodiment, in which a second vibrating membrane is not illustrated.
Figure 6A:
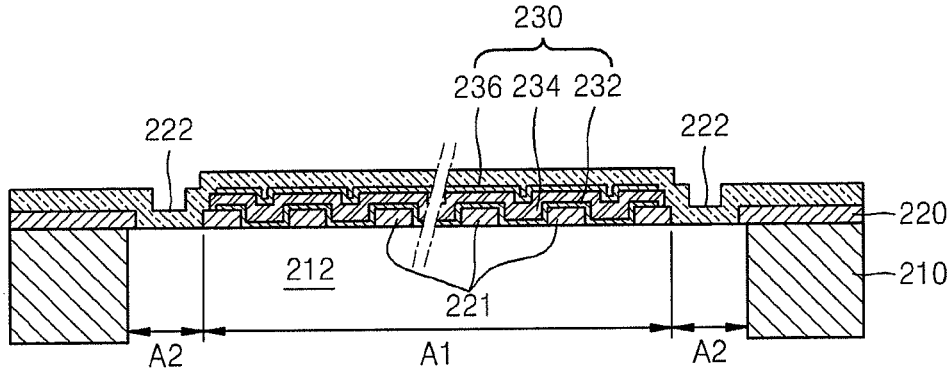
FIG. 6A is a cross-sectional view taken along a line S2-S2' of the piezoelectric micro speaker of FIG. 5.
Figure 6B:
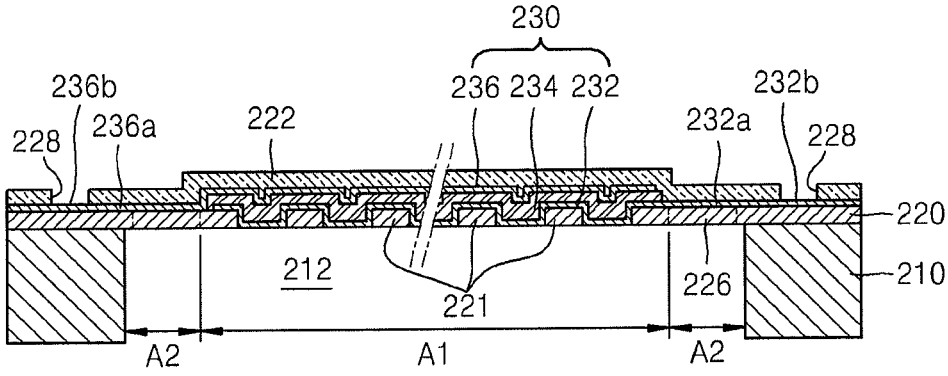
FIG. 6B is a cross-sectional view taken along a line S3-S3' of the piezoelectric micro speaker of FIG. 5, according to an embodiment.

FIG. 5 is a plan view of a piezoelectric micro speaker according to another embodiment, in which a second vibrating membrane 222 is not illustrated, FIG. 6A is a cross-sectional view taken along a line S2-S2' of the piezoelectric micro speaker of FIG. 5, and FIG. 6B is a cross-sectional view taken along a line S3-S3' of the piezoelectric micro speaker of FIG. 5.

Referring to FIGS. 5 through 6B, the piezoelectric micro speaker according to the present embodiment includes a diaphragm 220 which is formed on the substrate 210 such that the diaphragm 220 covers a cavity 212. The diaphragm 220 includes a plurality of first vibrating membranes 221 each having an annular ring shape and a second vibrating membrane 222 made of a different material from that of the first vibrating membranes 221. A piezoelectric actuator 230 is formed on the first vibrating membranes 221.

For example, the diaphragm 220 may be formed on a surface of the substrate 210 and may have a predetermined thickness. The first vibrating membranes 221 may be formed in a first region Al of the diaphragm 220 corresponding to the center of the cavity 212, and may have a plurality of concentric annular ring shapes. The second vibrating membrane 222 may be formed in a second region A2 (outside the first region Al) of the diaphragm 220, which corresponds to an edge of the cavity 212. That is, the second vibrating membrane 222 surrounds the first vibrating membranes 221. The second vibrating membrane 222 contacts a circumference of the outermost first vibrating membrane 221. The second vibrating membrane 222 is interposed between a portion of the diaphragm 220 disposed on the substrate 210 and the first vibrating membranes 221 and connects the portion of the diaphragm 220 to the first vibrating membranes 221, thereby supporting the first vibrating membranes 221 and the piezoelectric actuator 230 formed on the first vibrating membranes 221 with respect to the substrate 210. The second vibrating membrane 222 may also be formed on a top surface of the piezoelectric actuator 230, corresponding to the first region Al inside the second region A2, and formed in a region outside the second region A2, on a top surface of the diaphragm 220. In this regard, the second vibrating membrane 222 may have openings 228 for exposing a first electrode pad 232*b* and a second electrode pad 236*b*, which will be described later.

The first vibrating membranes 221 may include materials different from those of the second vibrating membrane 222. The second vibrating membrane 222 may include a soft material having a low elastic modulus so that the second vibrating membrane 222 is more easily deformed than the first vibrating membranes 221. In this regard, the first vibrating membranes 221 may include a material having an elastic modulus of about 50 GPa to 500 GPa, for example, silicon nitride, and the second vibrating membrane 222 may include a material having an elastic modulus of about 100 MPa to 5 GPa, for example, a polymer.

The piezoelectric actuator 230 may include a first electrode layer 232, a piezoelectric layer 234, and a second electrode layer 236, which are sequentially stacked in this stated order on a top surface of and between the first vibrating membranes 221. The first electrode layer 232 and the second electrode layer 236 may each include a conducting metallic material, and the piezoelectric layer 234 may include a piezoelectric material, for example, MN, ZnO or PZT.

A first lead line 232*a* that is connected to the first electrode layer 232 of the piezoelectric actuator 230 and a second lead line 236*a* that is connected to the second electrode layer 236 of the piezoelectric actuator 230 may be formed on the diaphragm 220. The first lead line 232*a* and the second lead line 236*a* may extend in opposite directions to each other while the piezoelectric actuator 230 is interposed therebetween. A first electrode pad 232*b* is formed at an end of the first lead line 232*a*, and a second electrode pad 236*b* is formed at an end of the second lead line 236*a*. A support 226 for supporting the first lead line 232*a* and the second lead line 236*a* may be formed in the second region A2. The support 226 may be formed of the same material as the first vibrating membranes 221, and may extend through the second region A2 and connect the outermost first vibrating membrane 221 to the portion of the diaphragm 220 disposed on the substrate 210. As described above, although the second vibrating membrane 222 connects the portion of the diaphragm 220 disposed on the substrate 210 to the first vibrating membranes 221, in an area where the first lead line 232*a* and the second lead line 236*a* are formed, the support 226 connects the portion of the diaphragm 220 disposed on the substrate 210 to the first vibrating membranes 221.

As described above, in the embodiment illustrated in FIGS. 5 through 6B, the first vibrating membranes 221 are spaced apart from each other and each of the first vibrating membranes 221 has an annular ring shape, which is the same structure as described with reference to FIGS. 3 through 4B. Thus, the effects that have been described with reference to FIG. 1 may also be obtained in the present embodiment. In addition, since the second vibrating membrane 222 including a soft material having a relatively lower elastic modulus is disposed in the second region A2 of the diaphragm 220 corresponding to an edge of the cavity 212, the overall structural rigidity of the diaphragm 200 may be lowered and the deformation may also be enhanced.

Figure 7:
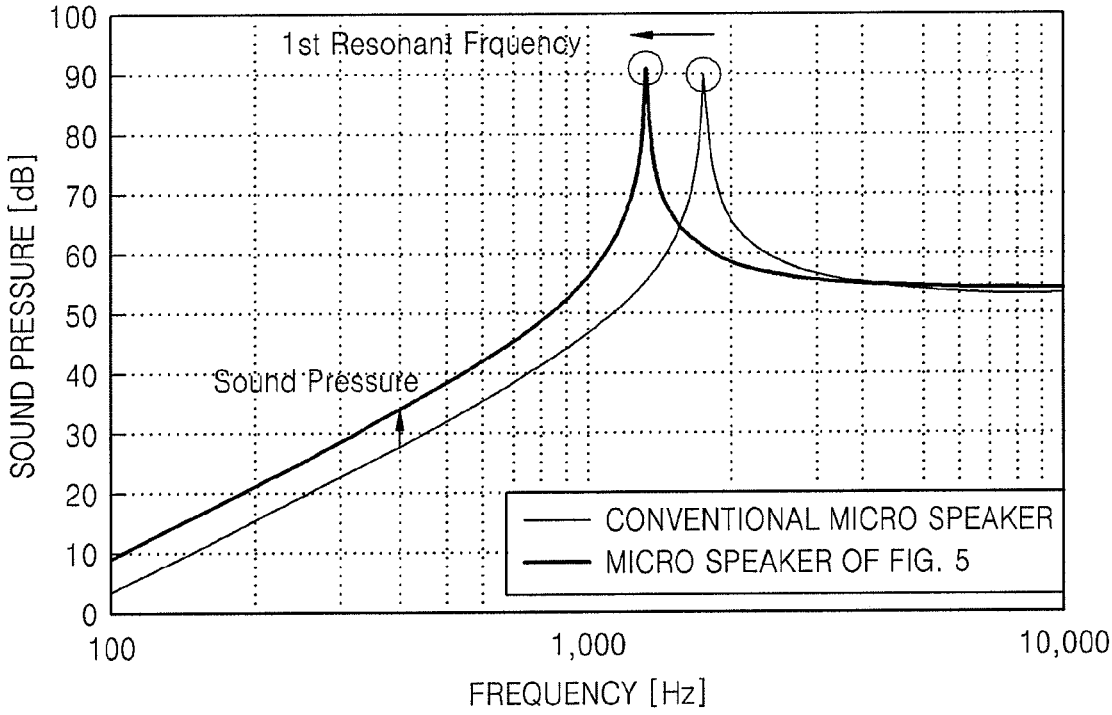
FIG. 7 is a graph of simulation results of frequency response characteristics of the piezoelectric micro speaker of FIG. 5, obtained by two-dimensional finite element analysis, which are compared with frequency response characteristics of a conventional micro speaker.

FIG. 7 is a graph of simulation results of frequency response characteristics of the piezoelectric micro speaker of FIG. 5, obtained by two-dimensional finite element analysis, which are compared with frequency response characteristics of a conventional micro speaker.

Referring to FIG. 7, a first resonant frequency of a conventional micro speaker including a flat-shaped vibrating membrane is about 1.75 KHz, and a first resonant frequency of the piezoelectric micro speaker of FIG. 5 is about 1.32 KHz. That is, the first resonant frequency of the piezoelectric micro speaker of FIG. 5 is lower than the first resonant frequency of the conventional micro speaker by about 430 Hz, and thus the bandwidth is enlarged and an average sound pressure in a low frequency bandwidth of 0.1 to 1 KHz is increased by about 6 dB.

Hereinafter, a method of manufacturing a piezoelectric micro speaker having the structure described above will be described in detail.

FIGS. 8A through 8D are views sequentially illustrating a method of manufacturing the piezoelectric micro speaker of FIG. 1, according to an embodiment.

Figure 8A:
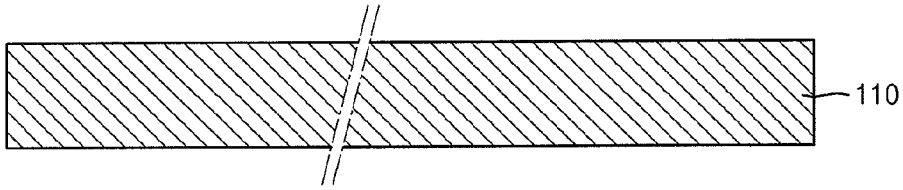
FIGS. 8A through 8D are views sequentially illustrating a method of manufacturing the piezoelectric micro speaker of FIG. 1, according to an embodiment.

First, referring to FIG. 8A, the substrate 110 is prepared. The substrate 110 may be a silicon wafer having excellent micro-processability.

Figure 8B:
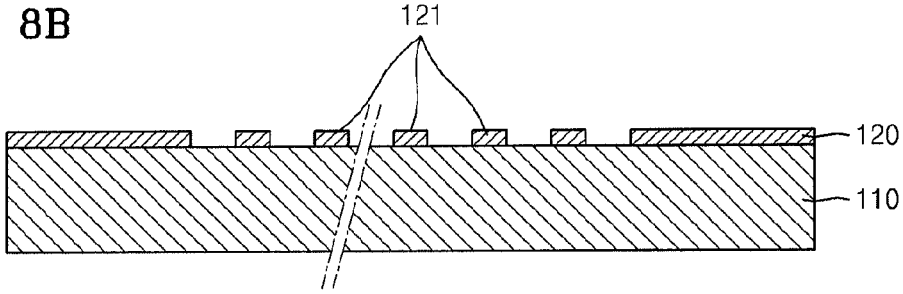

Then, as illustrated in FIG. 8B, the diaphragm 120 is formed on a surface of the substrate 110 to have a predetermined thickness. For example, the diaphragm 120 may be formed by depositing an insulating material such as silicon nitride, for example, $Si_3N_4$ on a surface of the substrate 110 to a thickness of 0.5 to 3 gm by chemical vapor deposition (CVD).

Then, the diaphragm 120 is patterned to form the first vibrating membranes 121 having concentric annular ring shapes. The first vibrating membranes 121 are formed in the first region of the diaphragm 120 which is located at the center of the cavity 112 which will be formed later in an operation illustrated in FIG. 8D. The distance between adjacent first vibrating membranes 121 may be at least twice the thickness of the piezoelectric actuator 130 which will be formed later in an operation illustrated in FIG. 8C.

Figure 8C:
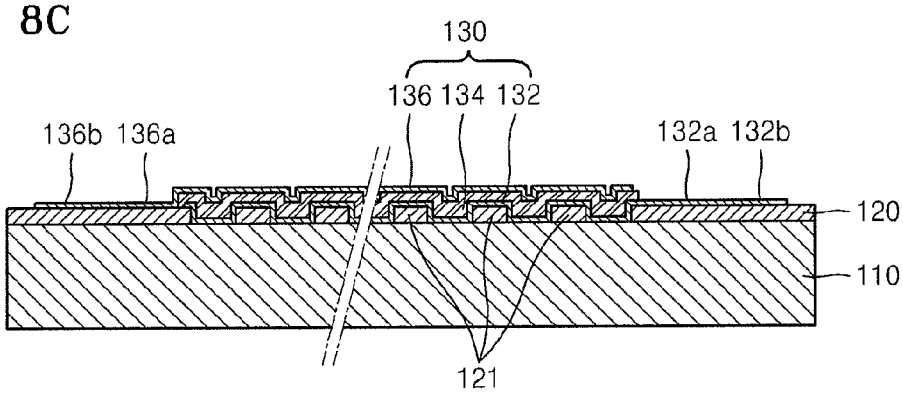

Then, as illustrated in FIG. 8C, the piezoelectric actuator 130 is formed on the top surface of and between the first vibrating membranes 121. The piezoelectric actuator 130 may be formed by sequentially stacking the first electrode layer 132, the piezoelectric layer 134, and the second electrode layer 136 on the top surface of and between the first vibrating membranes 121. For example, the first electrode layer 132 may be formed by depositing a conducting metallic material such as Au, Mo, Cu, Al, Pt, or Ti on the first vibrating membranes 121 to a thickness of 0.1 μm to 3 μm by sputtering or evaporation, and then patterning the conducting metallic material layer to obtain a predetermined shape by etching. The formation of the first electrode layer 132 may be simultaneously performed together with formation of the first lead line 132*a* that is connected to the first electrode layer 132 and the first electrode pad 132*b* that is connected to the end of the first lead line 132*a* on the diaphragm 120. The piezoelectric layer 134 may be formed by sputtering or spinning a piezoelectric material, for example, AN, ZnO, or PZT, on the first electrode layer 132 to a thickness of 0.1 μm to 3 μm. The second electrode layer 136 may be formed on the piezoelectric layer 134 by using the same method used to form the first electrode layer 132. The formation of the second electrode layer 136 may be simultaneously performed together with formation of the second lead line 136*a* that is connected to the second electrode layer 136 and the second electrode pad 136*b* that is connected to the end of the second lead line 136*a* on the diaphragm 120. The second lead line 136*a* and the first lead line 132*a* may extend in opposite directions to each other while the piezoelectric actuator 130 is interposed therebetween.

When these operations are completed, the piezoelectric actuator 130 having a corrugated cross-sectional shape is formed, and the first electrode layer 132 and the second electrode layer 136 which face each other vertically and horizontally between the first vibrating membranes 121 are formed.

Figure 8D:
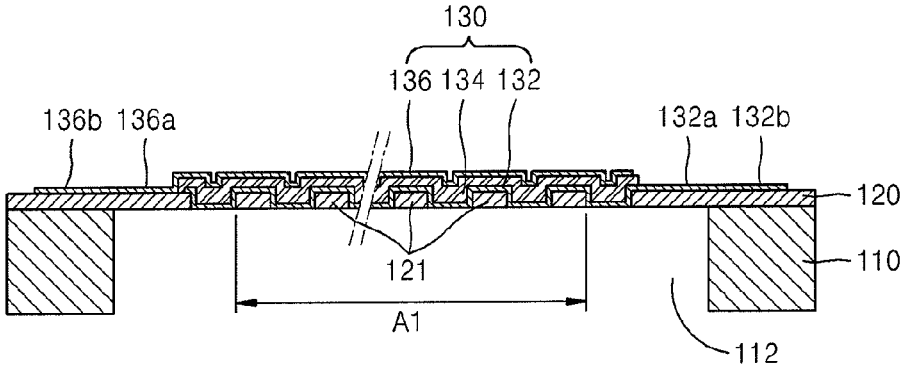

Then, as illustrated in FIG. 8D, a portion of the bottom surface of the substrate 110 is etched until the first vibrating membranes 121 are exposed, thereby forming the cavity 112 in the substrate 110 in the thickness direction of the substrate 110. In this regard, as described above, this operation is performed such that the first vibrating membranes 121 are located in the first region Al corresponding to the center of the cavity 112.

Thus, the manufacture of the piezoelectric micro speaker of FIG. 1, including the first vibrating membranes 121 each having an annular ring shape located in the first region Al corresponding to the center of the cavity 112 is completed.

FIGS. 9A through 9E are views sequentially illustrating a method of manufacturing the piezoelectric micro speaker of FIG. 5, according to another embodiment.

Figure 9A:
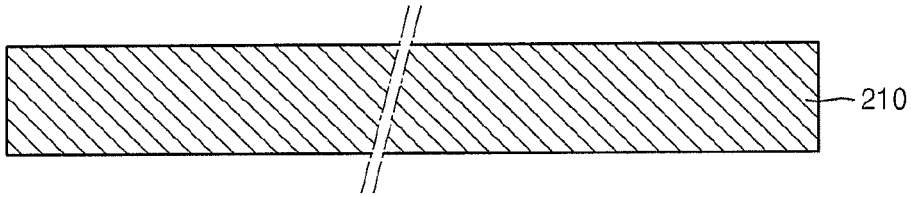
FIGS. 9A through 9E are views sequentially illustrating a method of manufacturing the piezoelectric micro speaker of FIG. 5, according to another embodiment.

First, referring to FIG. 9A, the substrate 210 is prepared. The substrate 210 may be a silicon wafer having excellent micro-processability.

Figure 9B:
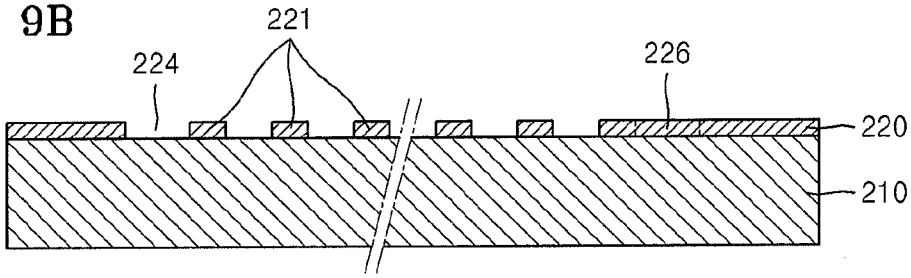

Then, as illustrated in FIG. 9B, the diaphragm 220 is formed on the surface of the substrate 210 to have a predetermined thickness. Then, the diaphragm 220 is patterned to form the first vibrating membranes 221 having concentric annular ring shapes. Since the diaphragm 220 and the first vibrating membranes 221 are formed by using the same methods used to form the diaphragm 120 and the first vibrating membranes 121 illustrated in FIG. 8B, the manufacture methods thereof will not be repeated here.

Then, a trench 224 surrounding the first vibrating membranes 221 is formed in the second region A2 of the diaphragm 220, corresponding to where an edge of the cavity 212 will be formed by etching the diaphragm 220, while forming the first vibrating membranes 221. With respect to the second region A2, however, in a portion of the second region A2 in which the first lead line 232*a* and the second lead line 236*a* will be formed later in an operation illustrated in FIG. 9C, the supports 226, which will support the first lead line 232*a* and the second lead line 236*a*, may be formed instead of the trench 224.

Figure 9C:
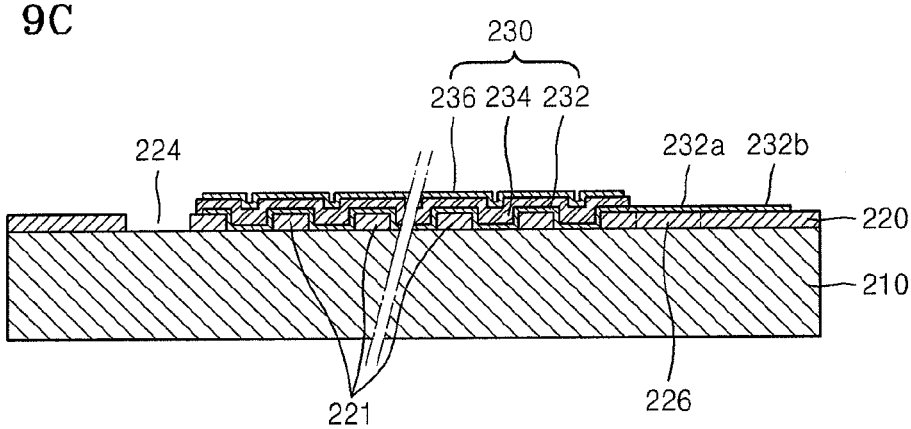

Then, as illustrated in FIG. 9C, the piezoelectric actuator 230 is formed on the top surface of and between the first vibrating membranes 221. The piezoelectric actuator 230 may be formed by sequentially stacking the first electrode layer 232, the piezoelectric layer 234, and the second electrode layer 236 on the top surface and between the first vibrating membranes 221. Since the piezoelectric actuator 230 may be formed in the same manner as that used to form the piezoelectric actuator 130 of FIG. 8C, the manufacturing method thereof will not be repeated here.

Then, the formation of the first electrode layer 232 may be simultaneously performed together with formation of the first lead line 232*a* that is connected to the first electrode layer 232 and the first electrode pad 232*b* that is connected to the end of the first lead line 232*a* on the diaphragm 220. In addition, the formation of the second electrode layer 236 may be simultaneously performed together with formation of the second lead line 236*a* that is connected to the second electrode layer 236 and the second electrode pad 236*b* that is connected to the end of the second lead line 236*a* on the diaphragm 220. The first lead line 232*a* and the second lead line 236*a* may be formed on the surface of the support 226.

Figure 9D:
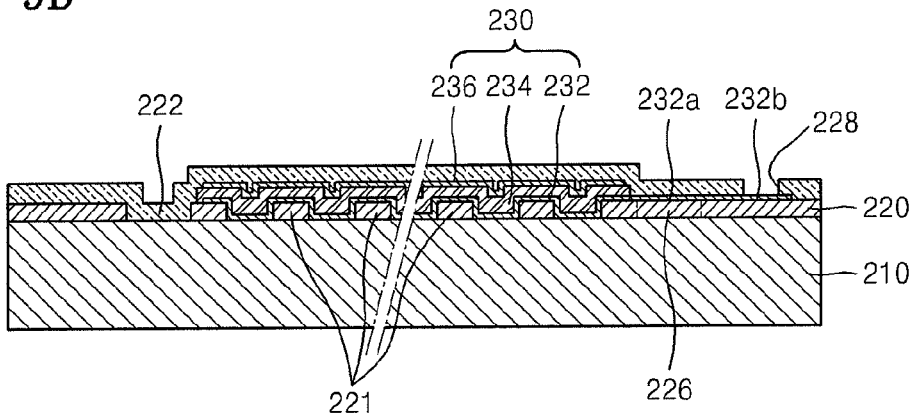

Then, referring to FIG. 9D, when the piezoelectric actuator 230 is completely formed, the second vibrating membrane 222 including a different material from that of the first vibrating membranes 221 may be formed in the trench 224. The second vibrating membrane 222 may include a soft material having a low elastic modulus so that the second vibrating membrane 222 is more easily deformed than the first vibrating membranes 221. For example, the first vibrating membranes 221 may include silicon nitride, and the second vibrating membrane 222 may include a polymer thin film having a thickness of about 0.5 to about 10 μm.

The second vibrating membrane 222 may also be formed on a top surface of the piezoelectric actuator 230, corresponding to the first region A1 within the second region A2, and formed in a region outside the second region A2, on a top surface of the diaphragm 220. In this case, the second vibrating membrane 222 may have an opening 228 for exposing the first electrode pad 232*b* and the second electrode pad 236*b*.

Figure 9E:
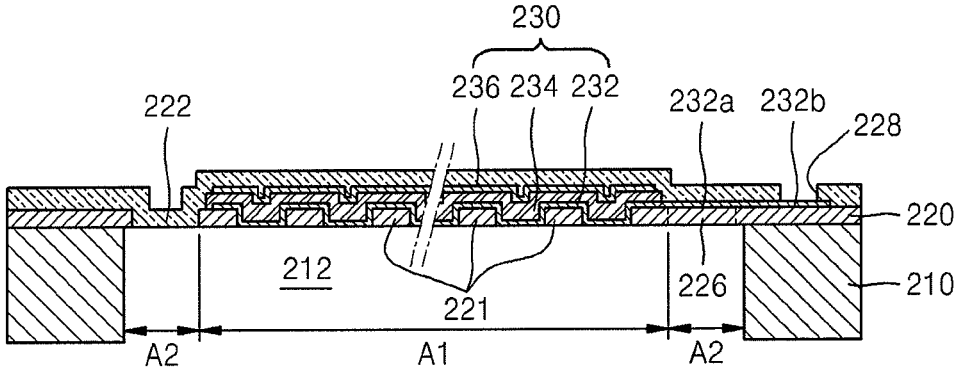

Then, as illustrated in FIG. 9E, a portion of the bottom surface of the substrate 210 is etched until the first vibrating membranes 221 and the second vibrating membrane 222 are exposed, thereby forming the cavity 212 in the substrate 210 in the thickness direction of the substrate 210. In this regard, as described above, this operation is performed such that the first vibrating membranes 221 are located in the first region Al corresponding to the center of the cavity 212, and the second vibrating membrane 222 is located in the second region A2 corresponding to the edge of the cavity 212.

Thus, the manufacture of the piezoelectric micro speaker of FIG. 5, including the first vibrating membranes 221 each having an annular ring shape located in the first region Al corresponding to the center of the cavity 212 and the second vibrating membrane 222 including a soft material located in the second region A2 corresponding to the edge of the cavity 212 is completed.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A micro speaker comprising:

a substrate having a cavity formed therein;

a diaphragm that is disposed directly on the substrate and overlaps the cavity, the diaphragm comprising a plurality of first vibrating membranes that are disposed in a first region of the diaphragm corresponding to a center of the cavity and have concentric annular ring shapes and are separated from each other; and a piezoelectric actuator that is disposed on and between the first vibrating membranes.

2. The micro speaker of claim 1, wherein the piezoelectric actuator comprises a first electrode layer that is disposed on and between the first vibrating membranes, a piezoelectric layer that is disposed on the first electrode layer, and a second electrode layer that is disposed on the piezoelectric layer.

3. The micro speaker of claim 2, wherein each of the first vibrating membranes separated from an adjacent one of the first vibrating membranes by a distance that is more than twice a thickness of the piezoelectric actuator.

4. The micro speaker of claim 3, wherein the piezoelectric actuator has a corrugated cross-sectional shape such that the first electrode layer and the second electrode layer face each other in a vertical direction in areas between the first vibrating membranes and face each other in a horizontal direction in areas on the top surfaces of the first vibrating membranes.

5. The micro speaker of claim 2, further comprising a first lead line that is disposed on the diaphragm and is connected to the first electrode layer;

a second lead line that is disposed on the diaphragm and is connected to the second electrode layer;

a first electrode pad that is connected to an end of the first lead line; and a second electrode pad that is connected to an end of the second lead line.

6. The micro speaker of claim 5, wherein the piezoelectric actuator is interposed between the first lead line and the second lead line, and the first lead line and the second lead line extend from the piezoelectric actuator in opposite directions.

7. The micro speaker of claim 1, wherein the diaphragm further comprises a second vibrating membrane that is disposed in a second region of the diaphragm corresponding to an edge of the cavity and comprises a material different from a material of the first vibrating membranes.

8. The micro speaker of claim 7, wherein the material of the second vibrating membrane has an elastic modulus that is lower than an elastic modulus of the material of the first vibrating membranes.

9. The micro speaker of claim 7, wherein the material of the second vibrating membrane comprises a polymer thin film.

10. The micro speaker of claim 7, wherein the second vibrating membrane is disposed in a second region of the diaphragm corresponding to an edge of the cavity, is disposed on a top surface of the piezoelectric actuator in the first region, and is disposed on a top surface of the diaphragm in a region surrounding the second region.

11. A method of manufacturing a micro speaker, the method comprising:

forming a diaphragm directly on a substrate;

forming a plurality of first vibrating membranes having concentric annular ring shapes by patterning the diaphragm, the plurality of the first vibrating membranes are separated from each other;

forming a piezoelectric actuator on and between the first vibrating membranes; and forming a cavity in the substrate in a thickness direction of the substrate by etching the substrate until the first vibrating membranes are exposed such that the first vibrating membranes are disposed in a first region corresponding to a center of the cavity.

12. The method of claim 11, wherein the forming the piezoelectric actuator comprises forming a first electrode layer on and between the first vibrating membranes, forming a piezoelectric layer on the first electrode layer, and a forming second electrode layer on the piezoelectric layer.

13. The method of claim 12, wherein each of the first vibrating membranes is separated from an adjacent one of the first vibrating membranes by a distance that is more than twice a thickness of the piezoelectric actuator.

14. The method of claim 13, wherein the piezoelectric actuator has a corrugated cross-sectional shape such that the first electrode layer and the second electrode layer face each other in a vertical direction in areas between the first vibrating membranes and face each other in a horizontal direction in areas on the top surfaces of the first vibrating membranes.

15. The method of claim 12, wherein the forming the piezoelectric actuator comprises:

forming a first lead line and a second lead line on the diaphragm, such that the first lead line is connected to the first electrode layer and the second lead line is connected to the second electrode layer;

forming a first electrode pad at an end of the first lead line; and forming a second electrode pad at an end of the second lead line.

16. The method of claim 15, wherein the piezoelectric actuator is interposed between the first lead line and the second lead line, and the first lead line and the second lead line extend from the piezoelectric actuator in opposite directions.

17. The method of claim 11, wherein the forming the plurality of first vibrating membranes comprises forming a trench surrounding the first vibrating membranes in a second region;

forming the cavity comprises forming the cavity such that an edge of the cavity corresponds to the second region;

the method further comprises, after the forming the piezoelectric actuator, forming a second vibrating membrane in the trench, wherein the second vibrating membrane comprises a material different from a material of the first vibrating membranes.

18. The method of claim 17, wherein the material of the second vibrating membrane has an elastic modulus that is lower than an elastic modulus of the material of the first vibrating membranes.

19. The method of claim 18, wherein the material of the second vibrating membrane comprises a polymer thin film.

20. The method of claim 17, wherein, the forming the second vibrating membrane further comprises forming the second vibrating membrane in the second region, forming the second vibrating membrane on a top surface of the piezoelectric actuator in the first region, and forming the vibrating membrane on a top surface of the diaphragm in a region surrounding the second region.

* * * * *